US007571982B2

(12) United States Patent
Koase

(10) Patent No.: US 7,571,982 B2
(45) Date of Patent: Aug. 11, 2009

(54) LIQUID EJECTING APPARATUS, LIQUID EJECTING SYSTEM, AND LIQUID EJECTING METHOD

(75) Inventor: Takashi Koase, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 11/802,832

(22) Filed: May 25, 2007

(65) Prior Publication Data

US 2008/0068411 A1 Mar. 20, 2008

(30) Foreign Application Priority Data

May 31, 2006 (JP) ..... 2006-151488

(51) Int. Cl.
*B41J 2/15* (2006.01)

(52) U.S. Cl. ..... 347/41; 347/13

(58) Field of Classification Search ..... 347/12, 347/13, 40, 15, 41, 43
See application file for complete search history.

(56) References Cited

U.S. PATENT DOCUMENTS 6,474,779 B2 * 11/2002 Inui et al. ..... 347/43
6,663,222 B2 12/2003 Verhoest et al.
6,948,796 B2 * 9/2005 Otsuki ..... 347/41
7,331,648 B2 * 2/2008 Niekawa ..... 347/41

FOREIGN PATENT DOCUMENTS

JP 6-219009 A 8/1994
JP 2002-210937 A 7/2002
JP 2003-118149 A 4/2003
JP 2004-330689 A 11/2004
JP 2005-022423 A 1/2005
JP 2007-253337 A 10/2007

* cited by examiner

*Primary Examiner*—Lamson D Nguyen
(74) *Attorney, Agent, or Firm*—Sughrue Mion, PLLC

(57) ABSTRACT

A liquid ejecting apparatus is provided that carries out dot forming at high speed and carries out dot forming at high resolution with respect to a medium. For this purpose, a controller that controls a liquid ejecting section and a relative movement mechanism such that dots are formed in either mode of a first mode and a second mode is provided. When dots are to be formed for all pixels in the first mode, first dots formed by nozzles of a first nozzle row and second dots formed by nozzles of a second nozzle row are alternately formed in a direction in which the nozzles are arranged, and a dot row of the first dots and a dot row of the second dots are formed in a direction perpendicular to the direction in which the nozzles are arranged. When dots are to be formed for all pixels in the second mode, the first dot row is formed so that the first dots are arranged in the direction in which the nozzles are arranged and the second dot row in which the second dots are arranged in the direction in which the nozzles are arranged is formed so as to be displaced from the first dot row in the perpendicular direction, and a distance in the perpendicular direction between the first dots is larger than a distance in the perpendicular direction between the first dots in the first mode.

6 Claims, 12 Drawing Sheets

100

LIQUID EJECTING APPARATUS, LIQUID EJECTING SYSTEM, AND LIQUID EJECTING METHOD

CROSS-REFERENCE TO RELATED APPLICATIONS

The present application claims priority upon Japanese Patent Application No. 2006-151488 filed on May 31, 2006, which is herein incorporated by reference.

TECHNICAL FIELD

The present invention relates to liquid ejecting apparatuses, liquid ejecting systems, and liquid ejecting methods.

RELATED ART

There are inkjet printers having multiple heads for ejecting liquid droplets as liquid ejecting apparatuses. Among such liquid ejecting apparatuses, there are liquid ejecting apparatuses in which multiple heads can be moved in a direction perpendicular to a relative movement direction of the heads with respect to a medium. And some of these can form two types of dots for high resolution and low resolution by moving the multiple heads in this manner (see JP-A-6-219009 and JP-A-2003-118149, for example).

With inkjet printers as liquid ejecting apparatuses, depending on the circumstances, there are times when it is desirable to print at high resolution and times when it is desirable to print at high speed. At these times, it is convenient if it is possible to alternately use these two types of printing by varying the ejection timing of the ink droplets and the like without causing the head to move in the direction perpendicular to the relative movement direction with respect to the medium. That is, it is preferable for a single liquid ejecting apparatus to be able to form high resolution dots and to be able to form dots at high speed on the medium.

SUMMARY

The invention has been contrived in view of the above circumstances, and an object thereof is to provide a liquid ejecting apparatus that carries out dot forming at high speed and dot forming at high resolution with respect to a medium.

An aspect of the invention for achieving the foregoing object is a liquid ejecting apparatus that includes:

a first nozzle row in which a plurality of nozzles for ejecting liquid droplets onto a medium to form dots on the medium are arranged with a predetermined pitch, a second nozzle row in which a plurality of nozzles for ejecting liquid droplets onto the medium to form dots on the medium are arranged with the predetermined pitch, the second nozzle row being displaced with respect to a position of the first nozzle row in a direction in which the nozzles are arranged, a relative movement mechanism that causes a position of the medium with respect to the first nozzle row and second nozzle row to move relatively in a direction perpendicular to the direction in which the nozzles are arranged, a liquid ejecting section installed for each nozzle of the first nozzle row and the second nozzle row, and a controller that controls the liquid ejecting section and the relative movement mechanism so that dots are formed in either mode of a first mode and a second mode, wherein, when dots are to be formed for all pixels in the first mode, first dots formed by nozzles of the first nozzle row and second dots formed by nozzles of the second nozzle row are alternately formed in the direction in which the nozzles are arranged, and a dot row of the first dots and a dot row of the second dots are formed in a direction perpendicular to the direction in which the nozzles are arranged, and when dots are to be formed for all pixels in the second mode, the first dot row is formed so that the first dots are arranged in the direction in which the nozzles are arranged, and the second dot row in which the second dots are arranged in the direction in which the nozzles are arranged is formed so as to be displaced from the first dot row in the perpendicular direction, and a distance in the perpendicular direction between the first dots is larger than a distance between the first dots in the first mode.

Another aspect of the invention for achieving the foregoing object is a printing system that includes:

a first nozzle row in which a plurality of nozzles for ejecting liquid droplets onto a medium to form dots on the medium are arranged with a predetermined pitch, a second nozzle row in which a plurality of nozzles for ejecting liquid droplets onto the medium to form dots on the medium are arranged with the predetermined pitch, the second nozzle row being displaced with respect to a position of the first nozzle row in a direction in which the nozzles are arranged, a relative movement mechanism that causes a position of the medium with respect to the first nozzle row and second nozzle row to move relatively in a direction perpendicular to the direction in which the nozzles are arranged, a liquid ejecting section installed for each nozzle of the first nozzle row and the second nozzle row, an input device for inputting an instruction as to whether dots are to be formed in either mode of a first mode and a second mode, and a controller that controls the liquid ejecting section and the relative movement mechanism so that dots are formed in either mode of the first mode and the second mode in accordance with the instruction inputted from the input device, wherein, when dots are to be formed for all pixels in the first mode, first dots formed by nozzles of the first nozzle row and second dots formed by nozzles of the second nozzle row are alternately formed in the direction in which the nozzles are arranged, and a dot row of the first dots and a dot row of the second dots are formed in a direction perpendicular to the direction in which the nozzles are arranged, and when dots are to be formed for all pixels in the second mode, the first dot row is formed so that the first dots are arranged in the direction in which the nozzles are arranged and the second dot row in which the second dots are arranged in the direction in which the nozzles are arranged is formed so as to be caused to be displaced from the first dot row in the perpendicular direction, and a distance in the perpendicular direction between the first dots is larger than a distance between the first dots in the first mode.

Another aspect of the invention for achieving the foregoing object is a liquid ejecting method that includes:

receiving an instruction as to whether to carry out dot forming in a first mode or to carry out dot forming in a second mode, when an instruction has been received for carrying out dot forming in the first mode, alternately forming first dots formed by nozzles of a first nozzle row and second dots formed by nozzles of a second nozzle row in a direction in which the nozzles are arranged, and forming a dot row of the first dots and a dot row of the second dots in a direction perpendicular to the direction in which the nozzles are arranged, and when an instruction has been received for carrying out dot forming in the second mode, forming the first dot row so that the first dots are arranged in the direction in which the nozzles are arranged and forming the second dot row, in which the second dots are arranged in the direction in which the nozzles are arranged, so as to be displaced from the first dot row in the perpendicular direction, wherein a distance in the perpendicular direction between the first dots is larger than a distance between the first dots in the first mode.

Other features of the invention will become clear through the accompanying drawings and the following description.

DESCRIPTION OF EMBODIMENTS

Figure 1:
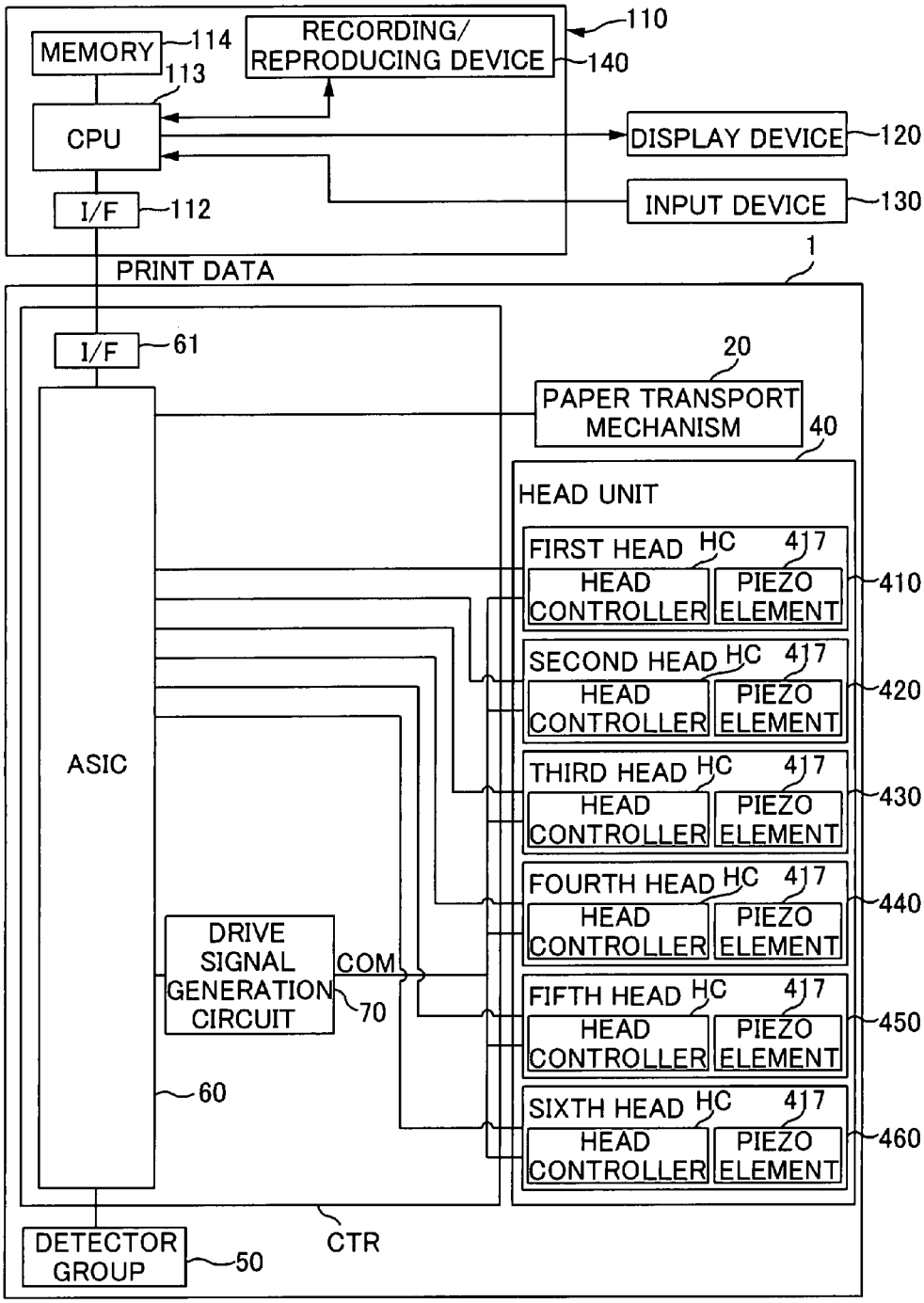
FIG. 1 is a block diagram of an overall configuration of a printing system according to a first embodiment.

At least the following matters will be made clear by the explanation in the present specification and the description of the accompanying drawings.

A liquid ejecting apparatus including:

a first nozzle row in which a plurality of nozzles for ejecting liquid droplets onto a medium to form dots on the medium are arranged with a predetermined pitch, a second nozzle row in which a plurality of nozzles for ejecting liquid droplets onto the medium to form dots on the medium are arranged with the predetermined pitch, the second nozzle row being displaced with respect to a position of the first nozzle row in a direction in which the nozzles are arranged, a relative movement mechanism that causes a position of the medium with respect to the first nozzle row and second nozzle row to move relatively in a direction perpendicular to the direction in which the nozzles are arranged, a liquid ejecting section provided for each nozzle of the first nozzle row and the second nozzle row, and a controller that controls the liquid ejecting section and the relative movement mechanism so that dots are formed in either mode of a first mode and a second mode, wherein, when dots are to be formed for all pixels in the first mode, first dots formed by nozzles of the first nozzle row and second dots formed by nozzles of the second nozzle row are alternately formed in the direction in which the nozzles are arranged, and a dot row of the first dots and a dot row of the second dots are formed in a direction perpendicular to the direction in which the nozzles are arranged, and when dots are to be formed for all pixels in the second mode, the first dot row is formed so that the first dots are arranged in the direction in which the nozzles are arranged, and the second dot row in which the second dots are arranged in the direction in which the nozzles are arranged is formed so as to be displaced from the first dot row in the perpendicular direction, and a distance in the perpendicular direction between the first dots is larger than that in the first mode.

By doing this, dot forming can be carried out at high resolution, and dot forming can be carried out at high speed on the medium.

In this liquid ejecting apparatus, it is preferable that the relative movement mechanism sets a relative movement velocity between the medium and the first nozzle row during the second mode faster than a relative movement velocity between the medium and the first nozzle row during the first mode.

Furthermore, it is preferable that the relative movement mechanism is a medium transport mechanism that transports the medium in a direction perpendicular to the direction in which the nozzles are arranged.

Furthermore, the relative movement mechanism may be a nozzle row movement mechanism that causes the first nozzle row and the second nozzle row to move in a direction perpendicular to the direction in which the nozzles are arranged.

Furthermore, it is preferable that nozzles of the second nozzle row are positioned center between nozzles of the first nozzle row in the direction in which the nozzles are arranged.

In this way, dot forming can be carried out at high resolution and dot forming can be carried out at high speed on the medium.

A printing system including:

a first nozzle row in which a plurality of nozzles for ejecting liquid droplets onto a medium to form dots on the medium are arranged with a predetermined pitch, a second nozzle row in which a plurality of nozzles for ejecting liquid droplets onto the medium to form dots on the medium are arranged with the predetermined pitch, the second nozzle row being displaced with respect to a position of the first nozzle row in a direction in which the nozzles are arranged, a relative movement mechanism that causes a position of the medium with respect to the first nozzle row and second nozzle row to move relatively in a direction perpendicular to the direction in which the nozzles are arranged, a liquid ejecting section provided for each nozzle of the first nozzle row and the second nozzle row, an input device for inputting an order that indicates in which mode of a first mode or a second mode dots are to be formed, and a controller that controls the liquid ejecting section and the relative movement mechanism so that dots are formed in either mode of the first mode and the second mode in accordance with the order inputted from the input device, wherein, when dots are to be formed for all pixels in the first mode, first dots formed by nozzles of the first nozzle row and second dots formed by nozzles of the second nozzle row are alternately formed in the direction in which the nozzles are arranged, and a dot row of the first dots and a dot row of the second dots are formed in a direction perpendicular to the direction in which the nozzles are arranged, and when dots are to be formed for all pixels in the second mode, the first dot row is formed so that the first dots are arranged in the direction in which the nozzles are arranged and the second dot row in which the second dots are arranged in the direction in which the nozzles are arranged is formed so as to be displaced from the first dot row in the perpendicular direction, and a distance in the perpendicular direction between the first dots is larger than a distance in the perpendicular direction between the first dots in the first mode.

A liquid ejecting method including:

receiving an order that indicates in which mode of a first mode or a second mode dots forming is to be carried out, when an order has been received for carrying out dot forming in the first mode, first dots formed by nozzles of the first nozzle row and second dots formed by nozzles of the second nozzle row are alternately formed in the direction in which the nozzles are arranged, and a dot row of the first dots and a dot row of the second dots are formed in a direction perpendicular to the direction in which the nozzles are arranged, and when an order has been received for carrying out dot forming in the second mode, the first dot row is formed so that the first dots are arranged in the direction in which the nozzles are arranged and the second dot row in which the second dots are arranged in the direction in which the nozzles are arranged is formed so as to be displaced from the first dot row in the perpendicular direction, wherein a distance in the perpendicular direction between first dots is larger than a distance in the perpendicular direction between first dots in the first mode.

By doing this, dot forming can be carried out at high resolution, and dot forming can be carried out at high speed on the medium.

First Embodiment

Regarding Overall Configuration

FIG. 1 is a block diagram of an overall configuration of a printing system according to a first embodiment. A printing system 100 is provided with a printer 1, a computer 110, a display device 120, and an input device 130. The display device 120 is used to provide a graphical user interface for enabling a user to select whether the printer 1 will be made to carry out printing in high resolution mode or to carry out printing in high speed printing mode. The input device is used to enable the user to instruct whether the printer 1 will be made to carry out printing in high resolution mode or to carry out printing in high speed printing mode. In the first embodiment, the printer 1 is an ink ejecting type line head printer that prints images on a medium such as paper, cloth, or film. The configuration of the printer 1 is discussed in detail later.

The computer 110 is provided with a CPU 113, a memory 114, an interface 112, and a recording/reproducing device 140. The CPU 113 executes various programs such as a printer driver and for example carries out image processing for images to be printed on the printer 1, which is discussed later. The memory 114 stores programs such as a printer driver and data. Furthermore, the memory 114 stores information indicating whether the user causes the printer 1 to carry out printing in high resolution mode or to carry out printing in high speed printing mode. The interface 112 is an interface such as USB or a parallel interface for connecting to the printer 1. The recording/reproducing device 140 is a device such as a CD-ROM drive or a hard disk drive for storing programs and data.

The computer 110 is communicably connected to the printer 1 via the interface 112, and outputs print data corresponding to an image that is to be printed, to the printer 1 in order to cause the printer 1 to print the image.

A printer driver is installed on the computer 110. The printer driver is a program for causing the display device 120 to display a user interface, and for causing image data output from an application program to be converted into print data. The printer driver has a function of resolution conversion processing in which when image data is received from an application, the image is converted to a resolution for printing. Furthermore, the printer driver has a function of halftone processing with regard to the image data after resolution conversion processing. It should be noted that halftone processing is a process of converting image data to data that represents any size of a formed dot, namely, no dot, small dot, medium dot, and large dot, for each pixel of the image data.

The printer driver can be installed from CD-ROM drive, which is the recording/reproducing device 140, or can be installed via the Internet. The printer driver is constituted by code for achieving various functions.

Note that "liquid ejecting apparatus" refers to an apparatus that ejects liquid droplets onto a medium, which corresponds to the printer 1, for example.

Regarding the Overall Configuration of the Printer 1

Figure 2A:
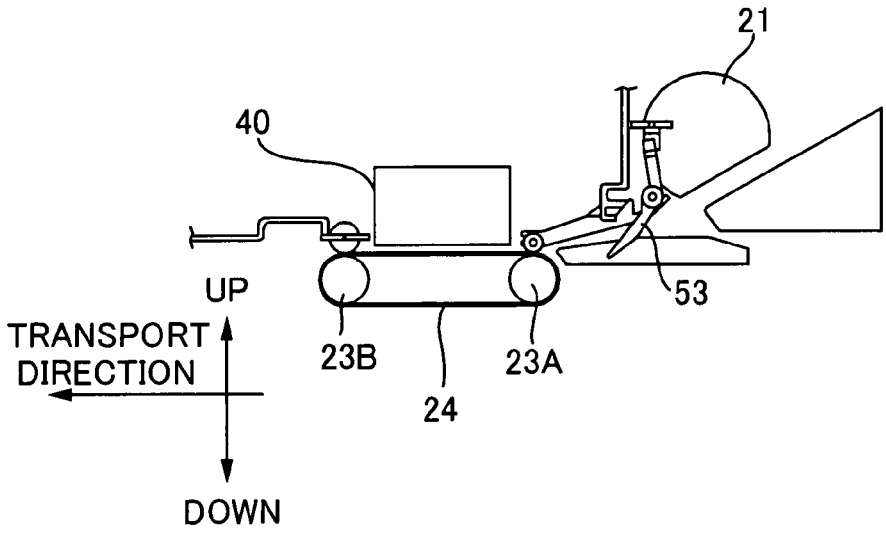
FIG. 2A is a cross-sectional view of a printer 1 according to the first embodiment.
Figure 2B:
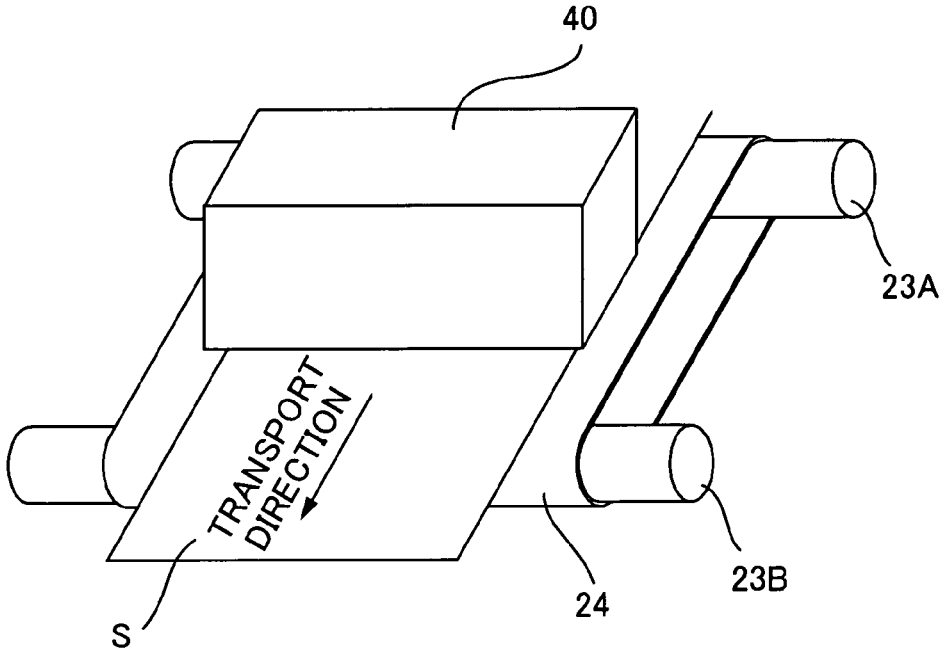
FIG. 2B is a perspective view for describing a transport process of a paper S in the printer 1 according to the first embodiment.

FIG. 2A is a cross-sectional view of the printer 1 according to the first embodiment. Furthermore, FIG. 2B is a perspective view for describing a transport process of paper S in the printer 1 according to the first embodiment. Hereinafter, a basic configuration of a line head printer, which serves as the printer of the first embodiment, is described with reference to FIG. 1.

The printer 1 of the first embodiment has a paper transport mechanism 20, a head unit 40, a detector group 50, an ASIC 60, and a drive signal generation circuit 70. The printer 1 receives print data from the computer 110. Then, based on the received data, the ASIC 60 of the printer 1 controls various sections of the printer 1 (the paper transport mechanism 20, the head unit 40, and the drive signal generation circuit 70) to print an image on the paper S.

The status of the printer 1 is monitored by the detector group 50. The detector group 50 outputs detection results to the ASIC 60. Then, based on these detection results, the ASIC 60 controls the various sections.

The paper transport mechanism 20 is for transporting a medium (such as the paper S for example) in a predetermined direction (hereinafter referred to as a "transport direction"). The paper transport mechanism 20 has a paper feed roller 21, a transport motor (not shown), an upstream-side transport roller 23A, a downstream-side transport roller 23B, and a belt 24. The paper feed roller 21 is a roller for feeding paper S that has been inserted into a paper insert opening into the printer. When the transport motor (not shown) rotates, the upstream-side transport roller 23A and the downstream-side transport roller 23B rotate, and the belt 24 rotates. The paper S that has been fed by the paper feed roller 21 is transported by the belt 24 up to a printable area (an area opposed to the heads). When the belt 24 transports the paper S, the paper S moves in the transport direction with respect to the head unit 40. The paper S that has passed through the printable area is discharged to the outside by the belt 24. It should be noted that during transport the paper S is electrostatically-adhered or vacuum-adhered to the belt 24.

The head unit 40 is for ejecting ink droplets onto the paper S. By ejecting ink droplets onto the paper S being transported, the head unit 40 forms dots on the paper S, thereby printing an image onto the paper S. The printer 1 of the first embodiment is a line head printer and, as is described later, the head unit 40 has six heads, a first head 410 to a sixth head 460. The configuration of the head unit 40 is described in detail later.

The detector group 50 includes such components as a rotary encoder (not shown) and a paper detection sensor 53. The rotary encoder detects the rotation amount of the upstream-side transport roller 23A and the downstream-side transport roller 23B. Based on the detection results of the rotary encoder, the ASIC 60 can detect a transport amount of the paper S.

The ASIC 60 is a control unit for carrying out control of the printer 1. The ASIC 60 is connected to an interface section 61 inside the printer 1 and can communicate with the computer 110. The ASIC 60 has a function of carrying out arithmetic processing for carrying out overall control of the printer. Furthermore, it includes a memory for storing programs and data and also controls various components in accordance with the programs stored in the memory.

The drive signal generation circuit 70 is a circuit that generates drive signals that are applied to piezo elements 417 inside the heads, which are described later, so as to cause ink droplets to be ejected from the nozzles. The drive signal generation circuit 70 outputs drive signals to the head unit 40 based on waveform data outputted from the ASIC 60. The drive signals are described later.

Regarding the Configuration of the Head Unit

As shown in FIG. 1, the head unit 40 contains six heads, the first head 410 to the sixth head 460. And each of these heads contains 360 nozzles and the piezo elements 417 for causing ink droplets to be ejected from these nozzles, as is described later. The piezo elements 417 are independently attached to each one of the nozzles. Furthermore, the drive pulse applied to the piezo element 417 of each nozzle is selected under the control of a head controller HC. Then, an ink droplet is caused to be ejected from the individual nozzles by applying the drive pulses to the piezo elements 417.

Figure 3:
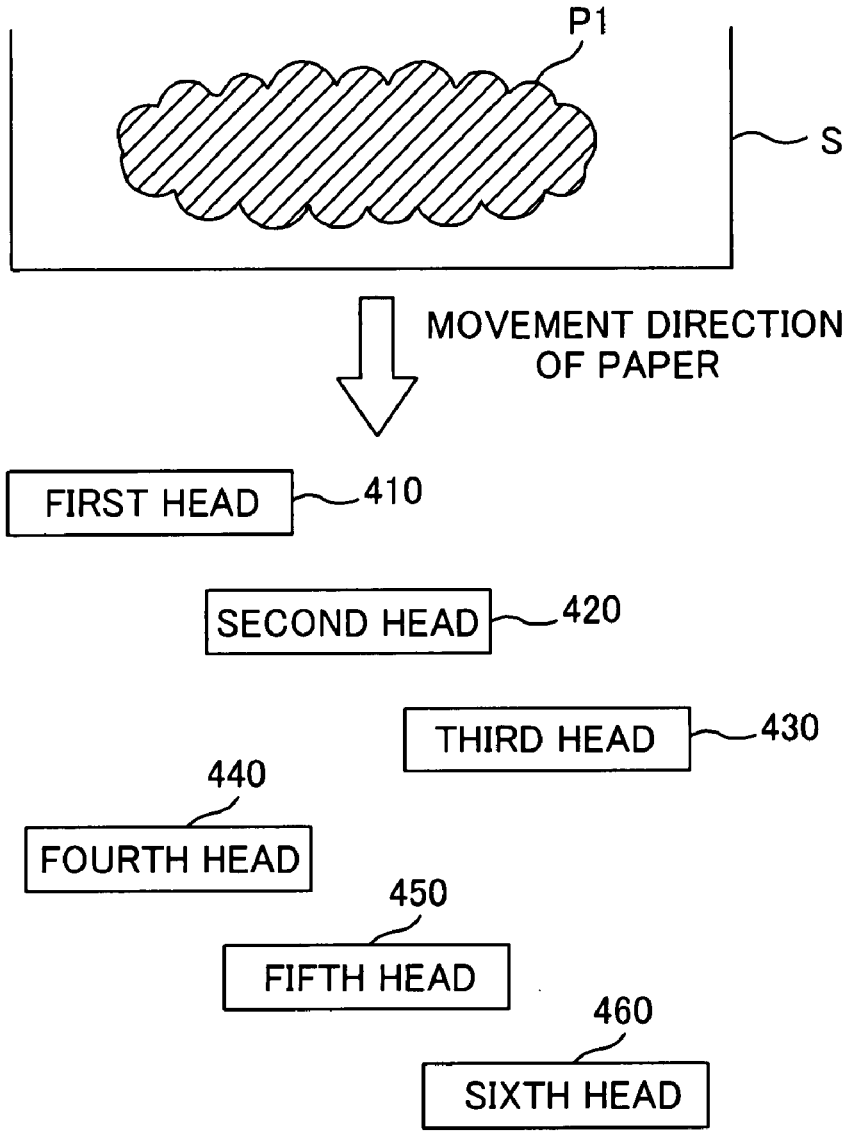
FIG. 3 is a diagram for describing an arrangement of six heads in a head unit 40 of the printer 1.

FIG. 3 is a diagram for describing the arrangement of the six heads (the first head 410 to the sixth head 460) in the head unit 40 of the printer 1. In the printer 1, the first head 410 to the sixth head 460 are arranged such that their nozzle rows are disposed along a direction perpendicular to the transport direction of the paper S. The positions of the first head 410 to the sixth head 460 are fixed. It should be noted that in the first embodiment, when the first head 410 is set as a first nozzle row, the fourth head 440 corresponds to a second nozzle row. Furthermore, when the second head 420 is set as the first nozzle row, the fifth head 450 corresponds to the second nozzle row. Furthermore, when the third head 430 is set as the first nozzle row, the sixth head 460 corresponds to the second nozzle row.

Next, description is given concerning the arrangement of the first head 410 to the sixth head 460. In the first embodiment, a large proportion of the fourth head 440 overlaps with the first head in the transport direction of the papers, and the nozzles of the fourth head 440 are arranged so as to be centered between the nozzles of the first head 410. Furthermore, a large proportion of the fifth head 450 overlaps with the second head 420 in the transport direction of the paper S, and the nozzles of the fifth head 450 are arranged so as to be centered between the nozzles of the second head 420. Furthermore, a large proportion of the sixth head 460 overlaps with the third head 430 in the transport direction of the paper S, and the nozzles of the sixth head 460 are arranged so as to be centered between the nozzles of the third head.

By adopting such configuration and ejecting ink droplets from the nozzles of the first head 410 to the sixth head 460, dots can be formed in a region of a full width of the paper S (a region substantially proportional to three heads). And by ejecting ink droplets from the first head 410 to the sixth head 460 while causing the paper S to move in the transport direction, an image can be formed on substantially the entire region of the paper S. Since the row direction size of each head is approximately one inch (about 2.54 cm), it becomes possible to form an image of approximately three inches (about 7.62 cm) in the paper width direction.

Figure 4:
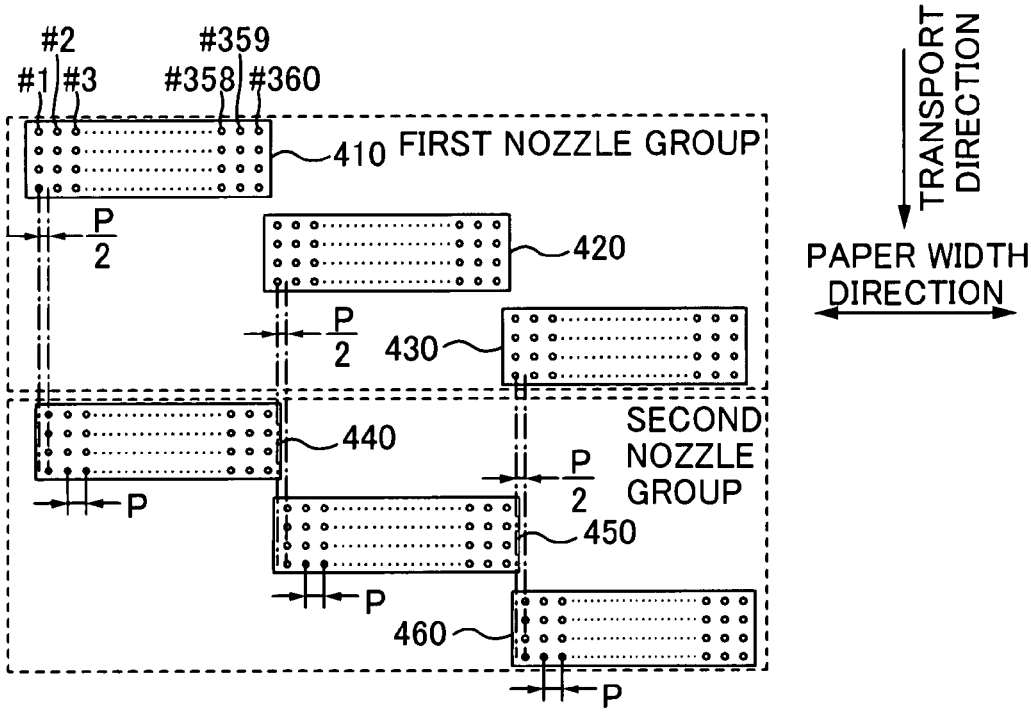
FIG. 4 is a diagram for describing a detailed arrangement of the six heads of the head unit 40 according to the first embodiment.

FIG. 4 is a diagram for describing a detailed arrangement of the six heads of the head unit 40 according to the first embodiment. FIG. 4 is a diagram showing the first head 410 to the sixth head 460 of the head unit 40 viewed from above the printer 1. When viewed from above the printer 1, the nozzles of these heads are hidden by other components and cannot be seen. However, here the nozzle positions are drawn with solid lines to facilitate understanding of the positional relationships of the nozzles of the first head 410 to the nozzles of the sixth head 460.

In each head, a black ink nozzle row K, a cyan ink nozzle row C, a magenta ink nozzle row M, and a yellow ink nozzle row Y are formed. Each nozzle row is provided with a plurality of nozzles (360 nozzles in the first embodiment), which are ejection openings for ejecting ink. The plurality of nozzles in each nozzle row are arranged at a constant nozzle pitch in a paper width direction. Here the nozzle pitch is 1/360 inch. Each nozzle of each of the heads is assigned a number (#1 to #360) in order from the left in the drawing. It should be noted that "nozzle pitch" refers to a distance between the nozzles in the nozzle row direction in which the nozzles are arranged. Furthermore, the nozzle pitch is indicated with "P" (here, P is 1/360 inch) in the drawing.

In the first state, the nozzles of the fourth head 440 are arranged so as to be centered between the nozzles of the first head 410 with respect to the nozzle row direction. More specifically, nozzle #1 of the fourth head 440 is arranged so as to be centered between nozzle #1 and nozzle #2 of the first head 410 with respect to the nozzle row direction. Similarly, the nozzles of the fifth head 450 are arranged so as to be centered between the nozzles of the second head 420 with respect to the nozzle row direction. More specifically, nozzle #1 of the fifth head 450 is arranged so as to be centered between nozzle #1 and nozzle #2 of the second head 420 with respect to the nozzle row direction. Furthermore, the nozzles of the sixth head 460 are arranged so as to be centered between the nozzles of the third head 430 with respect to the nozzle row direction. More specifically, nozzle #1 of the sixth head is arranged so as to be centered between nozzle #1 and nozzle #2 of the third head 430 with respect to the nozzle row direction.

The nozzle pitch formed between the right edge nozzle (#360) of the first head 410 and the left edge nozzle (#1) of the second head is 1/360 inch. The nozzle pitch formed between the right edge nozzle (#360) of the second head 420 and the left edge nozzle (#1) of the third head 430 is 1/360 inch. And the nozzle pitch formed between the right edge nozzle (#360) of the fourth head 440 and the left edge nozzle (#1) of the fifth head is 1/360 inch. Furthermore, the nozzle pitch formed between the right edge nozzle (#360) of the fifth head 450 and the left edge nozzle (#1) of the sixth head 460 is 360 inch.

The nozzle pitch formed between the right edge nozzle (#360) of the fourth head 440 and the left edge nozzle (#1) of the second head 420 is 1/720 inch (P/2). The nozzle pitch formed between the right edge nozzle (#360) of the fifth head 450 and the left edge nozzle (#1) of the third head 430 is 1/720 inch (P/2).

By adopting such an arrangement, the nozzle pitch of the first nozzle row formed by the first head 410, the second head 420, and the third head 430 becomes 1/360 inch. And the nozzle pitch of the second nozzle row formed by the fourth head 440, the fifth head 450, and the sixth head 460 becomes 1/360 inch. And since the nozzles of the second nozzle row are arranged so as to be between the nozzles of the first nozzle row with respect to the nozzle row direction, the nozzle pitch formed between the nozzles of the first nozzle row and the nozzles of the second nozzle row becomes 1/720 inch (P/2).

Regarding Drive Signals and Dot Formation

In the first embodiment, drive pulses contained in the drive signal are selectively applied to the piezo elements 417. Then ink droplets inside the heads are ejected.

These drive signals are generated as follows. First, the drive signal generation circuit 70 receives drive signal waveform data from the ASIC 60. The drive signal generation circuit 70 performs D/A conversion on the waveform data to convert to analog voltage signals. Then, voltage amplification is carried out so that the voltage signals become a predetermined voltage and current amplification is carried out so that a predetermined amount of the piezo elements 417 can be driven sufficiently. The drive signals are generated in this manner.

Figure 5:
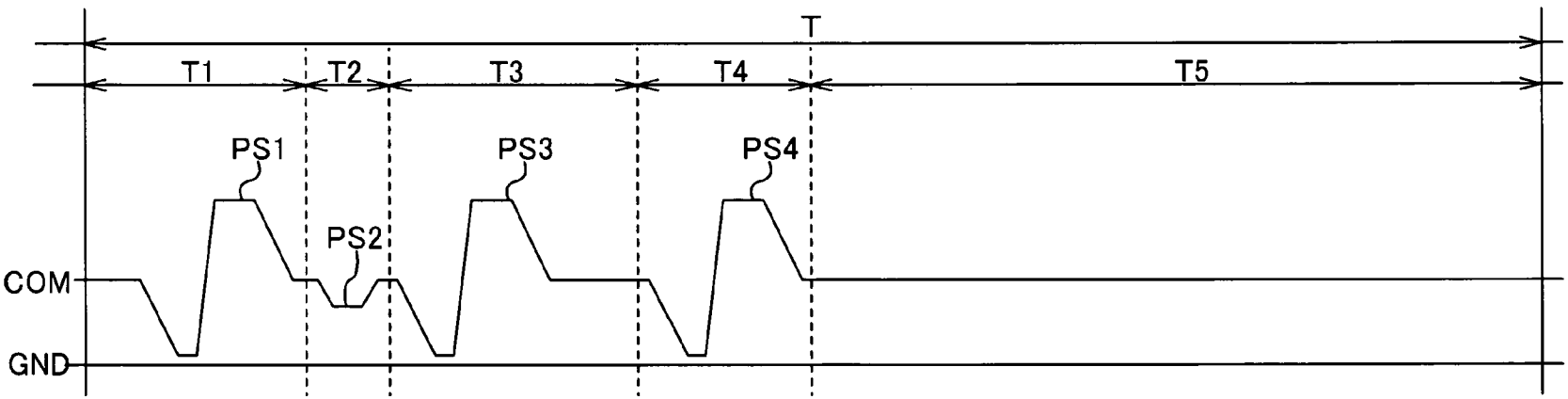
FIG. 5 is an example of the drive signals that are used.

FIG. 5 is an example of the drive signals that are used. A drive signal COM is outputted from the drive signal generation circuit 70 at a repetitive cycle of a cycle T. The cycle T includes periods T1 to T5. And a first drive pulse PS1 is contained in the period T1, a second drive pulse PS2 is contained in the period T2, a third drive pulse PS3 is contained in the period T3, and a fourth drive pulse PS4 is contained in the period T4.

No drive pulse is contained in the period T5. This is due to the following reason for example. The cycle T is an extremely short period. The piezo elements 417 are oscillated in the periods T1 to T4 and an ink meniscus (the ink surface at the face of the nozzle) is also caused to oscillate. A predetermined time is required until the oscillation of the ink meniscus to attenuate. For this reason, the period T5 is provided as a period for the oscillation of the ink meniscus to attenuate. In the present embodiment, the length of the period T5 is set to the same length as the length from the period T1 to T4. However, the length of the period T5 may be set longer or shorter than above-mentioned.

Regarding the shape of the drive pulses, only the second drive pulse PS2 is different from the other drive pulses, and the drive pulses PS1, PS3, and PS4 have the same shape. The drive pulse PS2 is a pulse that causes the piezo element 417 to oscillate slightly when no dot is being formed and is used for preventing thickening of ink by agitating the ink. The drive pulses PS1, PS3, and PS4 are drive pulses for causing ink droplets to be ejected from the nozzles. The printer 1 forms small dots, medium dots, and large dots by combining the applications of these drive pulses to the piezo elements 417.

For example, when forming a small dot, the third drive pulse PS3 is applied to the piezo element 417 to cause ejection of one liquid droplet in the period T. Furthermore, when forming a medium dot, the third drive pulse PS3 and the fourth drive pulse PS4 are applied to the piezo element 417 to cause ejection of two liquid droplets in the period T. When forming a large dot, the drive pulses PS1, PS3, and PS4 are applied to the piezo element 417 to cause ejection of three liquid droplets in the period T. In this manner, dots of a plurality of sizes can be formed by selectively applying the drive pulses to the piezo elements 417 in the period T.

The ASIC 60 generates pixel data SI based on the print data that has been sent from the computer 110. And based on the pixel data SI, the head controller HC selects drive pulses to be applied to the piezo elements 417.

As is described later, there are two modes of printing in the first embodiment, which are printing in high resolution mode and printing in high speed printing mode, however, common drive signals COM are used in both modes.

Regarding Operation

Next, description is given concerning a printing operation of the printer 1 in the first embodiment. Here, description is given concerning printing operations in high resolution mode and printing operations in high speed printing mode. Whether printing is carried out in high resolution mode or printing is carried out in high speed printing mode can be determined by a user giving an instruction to the computer 110. And information indicating in which mode printing is to be carried out is stored in the memory 114. This information is sent from the computer 110 to the ASIC 60 of the printer 1 when printing is to be carried out.

First, description is given concerning printing in high resolution mode. It should be noted that, here, for the purpose of description, description is given assuming large dots are formed in all of the pixels of the image to be printed. However, depending on the image to be printed, there may be some pixels for which dots are not formed.

When carrying out printing in high resolution mode, the ASIC 60 outputs waveform data to the drive signal generation circuit 70 that cause drive signals COM to be generated. Furthermore, the ASIC 60 controls the paper transport mechanism 20 so that the paper S is transported at half the speed of the high speed printing mode, which is to be described later. Accordingly, the paper S advances 1/720 inch in the transport direction in the cycle T of the drive signals COM.

Figure 6:
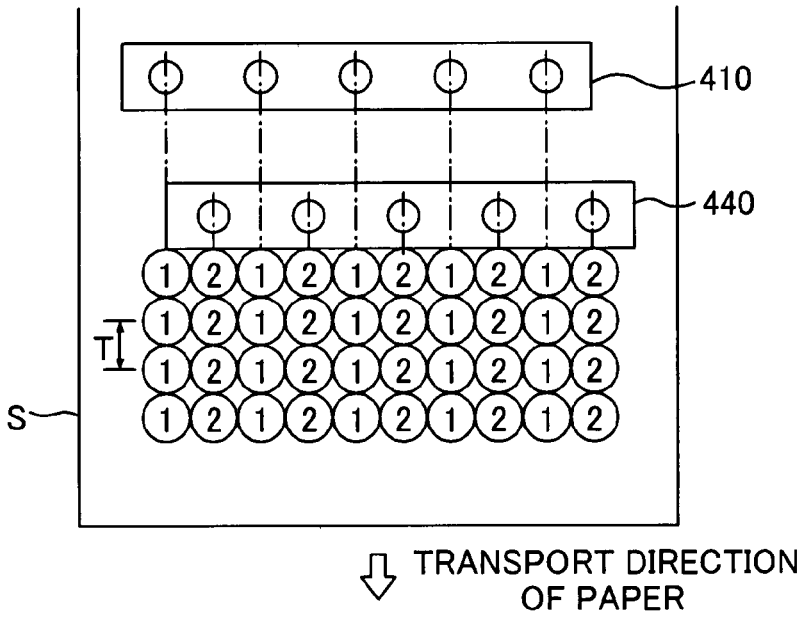
FIG. 6 is a diagram for describing an arrangement of dots when printing has been carried out in high resolution mode according to the first embodiment.

FIG. 6 is a diagram for describing an arrangement of dots when printing has been carried out in high resolution mode according to the first embodiment. In FIG. 6, only one nozzle row is included in one head in order to facilitate description of a relationship between the heads and the dots that are formed. Also, for the same reason, the number of nozzles is reduced in FIG. 6. Dots formed by ink droplets ejected from the head of the first nozzle row (here, the first head 410) are indicated by a numeral "1" enclosed in a circle. Furthermore, dots formed by ink droplets ejected from the head of the second nozzle group (here, the fourth head 440) are indicated by a numeral "2" enclosed in a circle. Furthermore, here, an arrangement of the nozzles of the first head 410 and the nozzles of the fourth head 440 is shown as a representation.

In the first embodiment, the paper S is transported continuously in a direction perpendicular to the nozzle rows. And printing is carried out by ink droplets ejected from the heads to form dots. The ejection timing of the ink droplets is regulated such that the dots formed by ink droplets ejected from the first head 410 and the dots formed by ink droplets ejected from the fourth head 440 are alternately arranged in the direction in which the nozzles are arranged.

The paper S advances 1/720 inch in the transport direction in the cycle T of the drive signals COM. And dots shown in FIG. 6 are formed in each of the cycles T. As a result, the first dots and the second dots are alternately arranged in the direction in which the nozzles are arranged and printing is carried out at 720 dpi.

Here, description is given by using the first head 410 and the fourth head 440, however, the first head 410 to the sixth head 460 are used in actual printing. In this case, the ejection timing of the ink droplets is regulated such that the dots formed by ink droplets ejected from the first head 410 to the sixth head 460 are arranged in one row in the direction in which the nozzles are arranged, and dots are formed. At this time, since it becomes possible to form dot rows for three heads in the paper width direction, an image of approximately three inches in the paper width direction can be formed.

Next, description is given concerning printing operation in high speed printing mode. When carrying out printing in high speed printing mode, the transport velocity of the paper S is twice that of high resolution mode. However, the printing in high speed printing mode that is described hereinafter does not simply double the transport velocity of the paper in high resolution mode.

Figure 7:
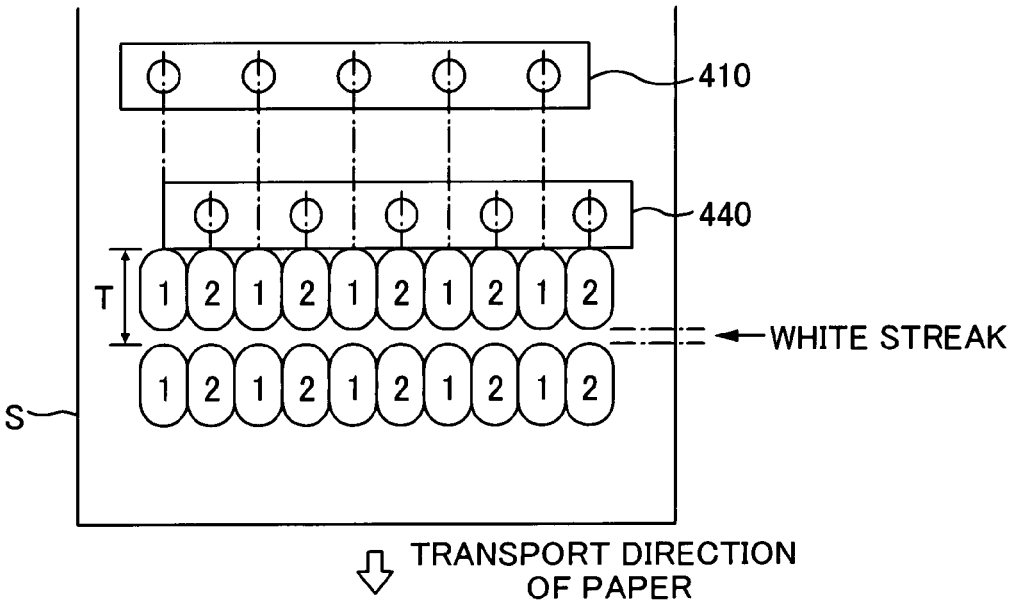
FIG. 7 is a diagram for describing an arrangement of dots when printing has been carried out in a doubled transport velocity of paper S in high resolution mode.

FIG. 7 is a diagram for describing an arrangement of dots when printing has been carried out in above-described high resolution mode with doubled transport velocity of paper S. This diagram is for comparing printing in high resolution mode with merely doubled transport velocity of paper with printing in high speed printing mode which is described below. As shown in FIG. 7, when the transport velocity of the paper S is merely doubled, a gap appears between dots in the transport direction of the paper S. This is because a region of a period in which ink droplets are not ejected in the period T5 of the drive signals COM cannot be filled by the spreading of ink droplets ejected in other periods. In this case, as a result white streaks occur in the nozzle row direction. Accordingly, in the present embodiment, printing is carried out in high speed printing mode in the following manner such that white streaks do not occur.

Figure 8:
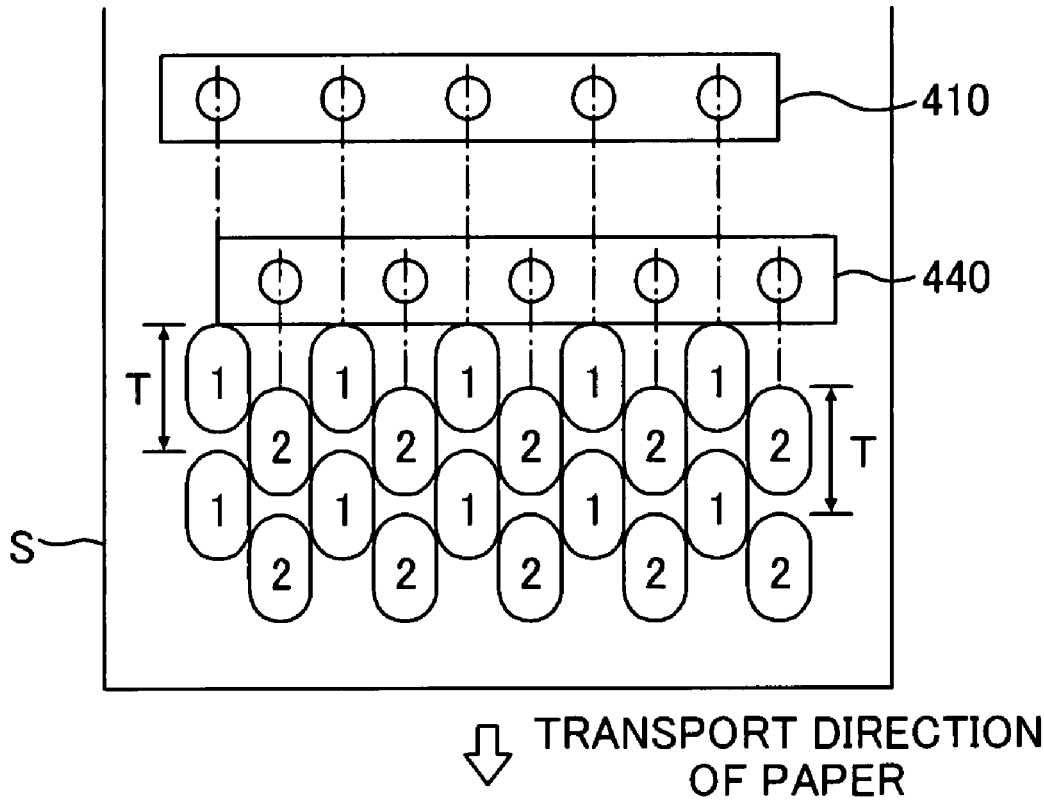
FIG. 8 is a diagram for describing an arrangement of dots when printing is carried out in high speed printing mode according to the first embodiment.

FIG. 8 is a diagram for describing an arrangement of dots when printing is carried out in high speed printing mode according to the first embodiment. FIG. 8 describes only one nozzle row in one head in order to facilitate description of a relationship between the heads and the dots that are formed. Also, for the same reason, the number of nozzles is reduced in FIG. 8. Dots formed by ink droplets ejected from the head of the first nozzle row (here, the first head 410) are indicated by a numeral "1" enclosed in a circle. Furthermore, dots in which ink droplets have been ejected from the head of the second nozzle row (here, the fourth head 440) are indicated by a numeral "2" enclosed in a circle.

When printing in high speed printing mode is selected by the user, the ASIC 60 outputs waveform data to the drive signal generation circuit 70 to enable drive signals COM to be generated. Furthermore, the ASIC 60 controls the paper transport mechanism 20 so that the paper S is transported at twice the velocity in high resolution mode during transportation. Accordingly, the paper S advances 1/360 inch in the transport direction during the cycle T of the second drive signals COM_2. Furthermore, the ASIC 60 makes the ejection timings for ink droplets of the first head 410 and the fourth head 440 to be different from that during high resolution mode.

In high speed printing mode, the ejection timings of ink droplets are regulated to achieve a dot arrangement as shown in FIG. 8. In FIG. 8, the dots (first dots) formed by ink droplets ejected from the first nozzle row (first head 410) are arranged in the nozzle row direction. Furthermore, the dots (second dots) formed by ink droplets ejected from the second nozzle row (fourth head 440) are also arranged in the nozzle row direction. However, the second dots are formed so as to be positioned between the first dots in the nozzle row direction. And dot rows of the second dots to be formed are displaced from the dot rows of the first dots in a direction perpendicular to the nozzle rows.

By carrying out printing in this manner, the interval between the first dots and the next first dots in the direction perpendicular to the nozzle rows is wider than the interval in high resolution mode. And since the transport velocity of the paper S in high speed printing mode is twice the velocity in high resolution mode, the printing speed can be approximately doubled.

Here, description is given using the first head 410 and the fourth head 440, however, the first head 410 to the sixth head 460 are used in actual printing. In this case, the ejection timing of the ink is regulated such that the dot rows formed by ink droplets ejected from the first head 410, the second head 420, and the third head 430 are arranged in one row in the paper width direction, and dots are formed. Furthermore, the ejection timing of the ink droplets is regulated such that the dot rows formed by ink droplets ejected from the fourth head 440, the fifth head 450, and the sixth head 460 are arranged in one row in the paper width direction, and dots are formed. At this time, since it is possible to form dot rows corresponding to substantially three heads in the paper width direction, an image of approximately three inches in the paper width direction can be formed.

Modified Example of the First Embodiment

Figure 9:
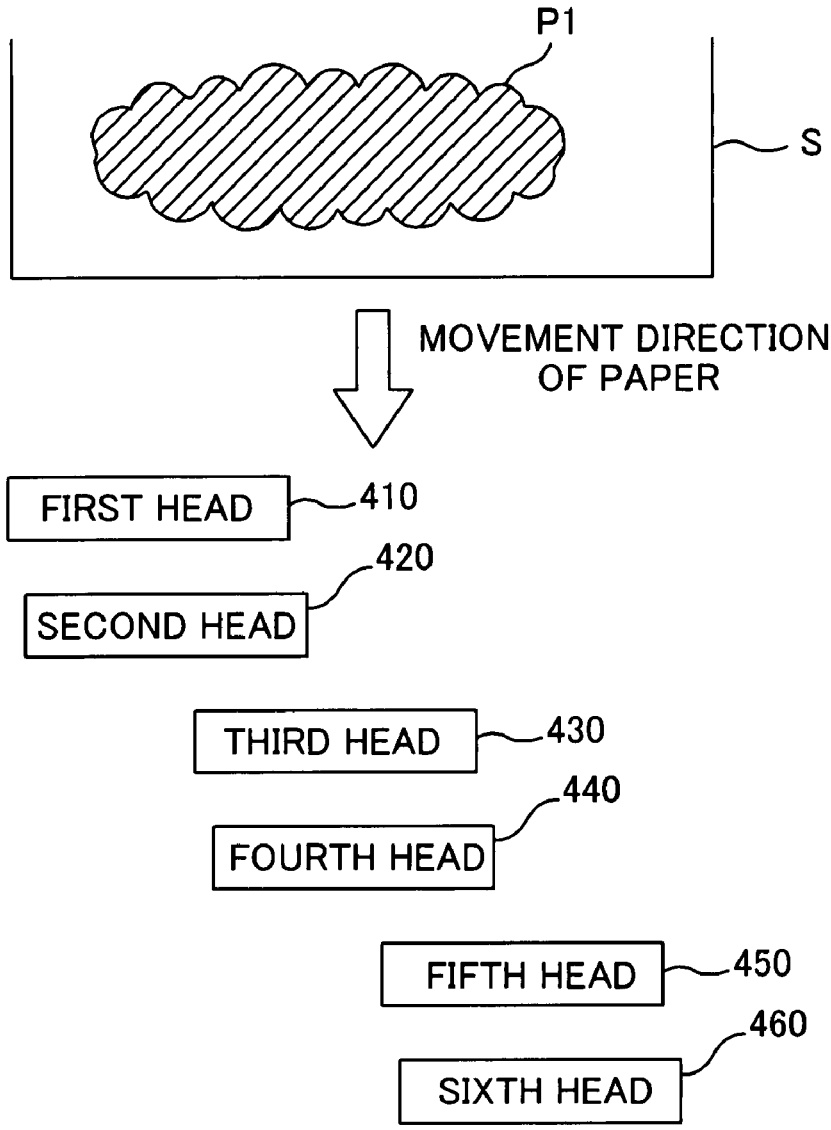
FIG. 9 shows a modified example of a head configuration of the first embodiment.

FIG. 9 shows a modified example of a head configuration of the first embodiment. When the first head 410 is set as a first nozzle row, the second head 420 corresponds to the second nozzle row. Furthermore, in this modified example, when the third head 430 is set as the first nozzle row, the fourth head 440 has a role as the second nozzle row. Furthermore, in this modified example, when the fifth head is set as the first nozzle row, the sixth head 460 corresponds to the second nozzle row.

By configuring the head arrangement as in the modified example, the first head 410 and the second head 420 are configured to be close in terms of distance. Also, the third head 430 and the fourth head 440 are configured to be close in terms of distance. And the fifth head 450 and the sixth head 460 are configured to be close in terms of distance. Furthermore, a relative positional relationship between the first head 410 and the second head 420 is in common with a relative positional relationship between the third head 430 and the fourth head 440. And a relative positional relationship between the second head 410 and the second head 420 is in common with a relative positional relationship between the fifth head 450 and the sixth head 460. Accordingly, there is an advantage in that the first head 410 and the second head 420 can be manufactured as a single unit, and can be used for a pair of the third head 430 and the fourth head 440, or used for a pair of the fifth head 450 and the sixth head 460.

On the other hand, from a perspective of the head arrangement, the embodiment described before the modified example has the following advantage. By using a head arrangement configuration described above in the embodiment described before the modified example, compared to the modified example, a larger distance is created between the heads of the first nozzle row (the first head 410 to the third head 430) and the heads of the second nozzle row overlapping these heads (the fourth head 440 to the sixth head 460). By creating a large distance in this manner more time is required from forming dots with ink droplets of the first nozzle row to forming dots with ink droplets of the second nozzle row. Accordingly, dot forming with ink droplets of the second nozzle row can be performed after ink droplets of the first nozzle row have dried.

Second Embodiment

Overall Configuration

Figure 10:
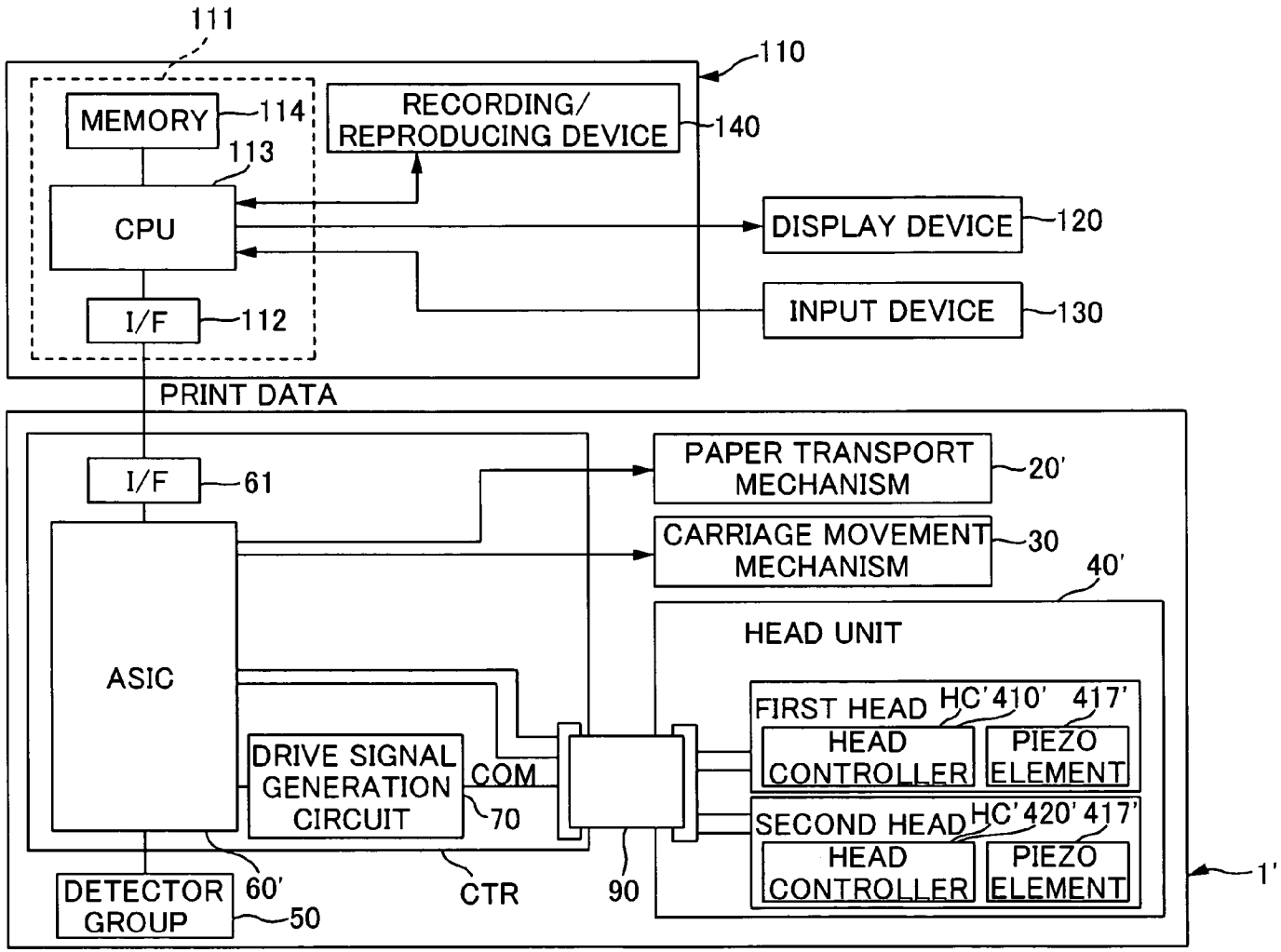
FIG. 10 is a block diagram of a printing system according to a second embodiment.

FIG. 10 is a block diagram of a printing system according to a second embodiment. A printing system 100' is provided with a printer 1', a computer 110, a display device 120, and an input device 130. In the second embodiment, the printer 1' is an inkjet printer that prints an image on a medium such as paper, cloth, or film.

Since the computer 110, the display device 120, and the input device 130 are the same as in the first embodiment, description thereof is omitted. Next, description is given concerning a configuration of the printer 1'in the second embodiment.

Overall Configuration of the Printer 1'

Figure 11A:
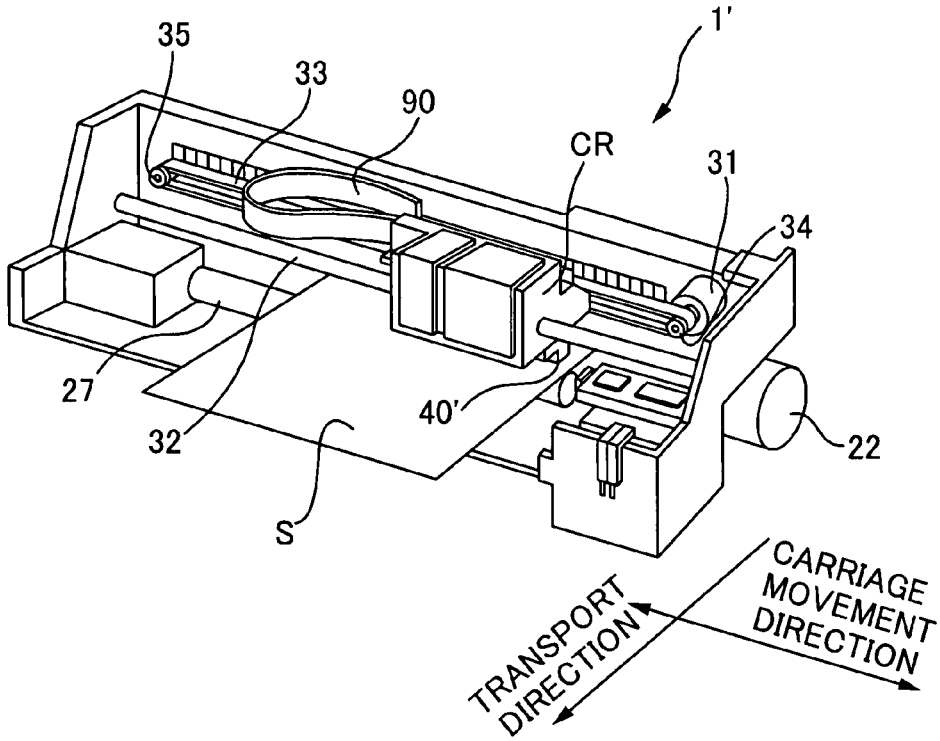
FIG. 11 includes FIG. 11A, which is a perspective view of a printer 1' according to the second embodiment, and FIG. 11B, which is a cross-sectional view of the printer 1' according to the second embodiment.
Figure 11B:
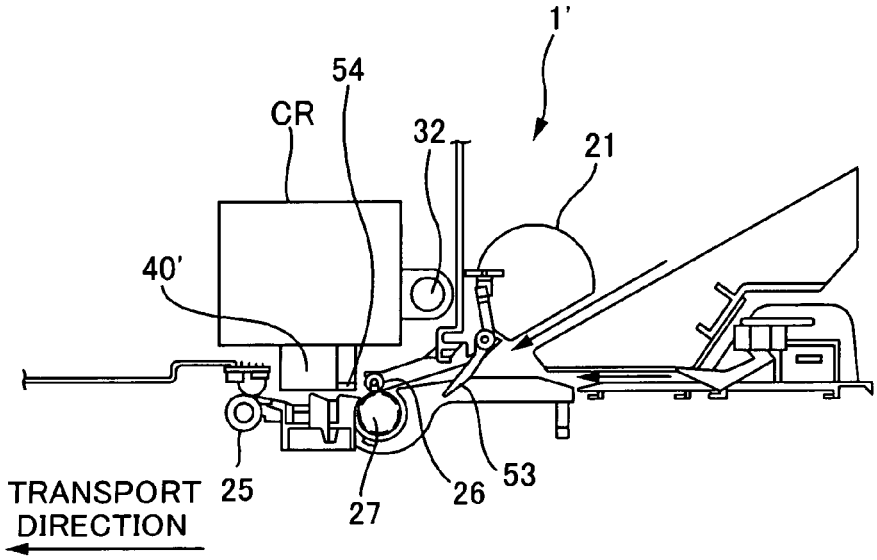

FIG. 11A is a perspective view of the printer 1' according to the second embodiment, and FIG. 11B is a cross-sectional view of the printer 1'according to the second embodiment. The following is a description concerning the basic configuration of an inkjet printer, which is the printer of the second embodiment also with reference to FIG. 10.

The printer 1' of the second embodiment includes a paper transport mechanism 20', a carriage movement mechanism 30, a head unit 40', a detector group 50, an ASIC 60', a drive signal generation circuit 70, and a flat cable 90.

The paper transport mechanism 20' feeds the paper S serving as a medium up to a printable position, and transports the paper S by a predetermined transport amount in the transport direction. The transport direction is a direction that intersects a carriage movement direction described next. As shown in FIG. 11A and FIG. 11B, the paper transport mechanism 20' includes a transport motor 22, a transport roller 27, and other components used in transporting the paper (a paper feed roller 21, and a discharge roller 25, and a driven roller 26). The transport motor 22 is a motor for transporting the paper S in the transport direction, and its operation is controlled by the ASIC 60'. The transport roller 27 is connected to the transport motor and transports the paper S up to a printable region. The paper transport mechanism 20 according to the first embodiment transported one sheet of paper continuously, but the paper transport mechanism 20' according to the second embodiment transports the paper S intermittently.

The carriage movement mechanism 30 is for moving the carriage CR, to which the head unit 40' is attached, in a movement direction of the carriage CR. The carriage movement mechanism corresponds to a nozzle movement mechanism that causes the first nozzle row and the second nozzle row to move in a direction perpendicular to the direction in which the nozzles are arranged. It should be noted that the head unit 40' has a first head 410' and a second head 420'.

The carriage movement mechanism 30 includes a carriage motor 31, a guide shaft 32, a timing belt 33, and other components used in moving the carriage CR (a drive pulley 34 and an idler pulley 35). And the carriage CR is configured to move along the guide shaft 32 by rotation of the carriage motor CR. The rotation of the carriage motor 31 is controlled by the ASIC 60'. Thus, movement of the carriage CR is also controlled by the ASIC 60'.

The head unit 40' is for ejecting ink droplets onto the paper S. The head unit 40' has the first head 410' and the second head 420', which are described later. The first head 410' and the second head 420' have a plurality of nozzles respectively (360 nozzles each in the second embodiment). The first head 410' and the second head 420' are provided in a carriage CR, and therefore when the carriage CR moves, the first head 410' and the second head 420' also move in the same direction. Then, dot rows are formed on the paper S along the movement direction due to ink being intermittently ejected during movement of the first head 410'and the second head 420'.

As shown in FIG. 10, the ASIC 60' and the drive signal generation circuit 70 are provided on the same substrate CTR. Furthermore, the inkjet printer 1' has the flat cable 90 for movably connecting the head unit 40 on the carriage CR to the substrate CTR in order to carry out printing while the carriage CR that holds the head unit 40' is caused to move.

Since the configurations of the detector group 50 and the drive signal generation circuit 70 are the same as in the first embodiment, description thereof is omitted.

Configuration of Head Unit 40'

As described above, the head unit 40' is configured so as to be contained in the carriage CR. And the first head 410' and the second head 420' are contained in the head unit 40'. Then, in these respective heads, there are included 360 nozzles and piezo elements 417 for causing ink droplets to be ejected from the nozzles. Furthermore, the drive pulses to be applied to the piezo elements 417 of the nozzles are selected under the control of the head controller HC'. And ink droplets are ejected from the individual nozzles due to the application of the drive pulses to the piezo elements 417.

Figure 12:
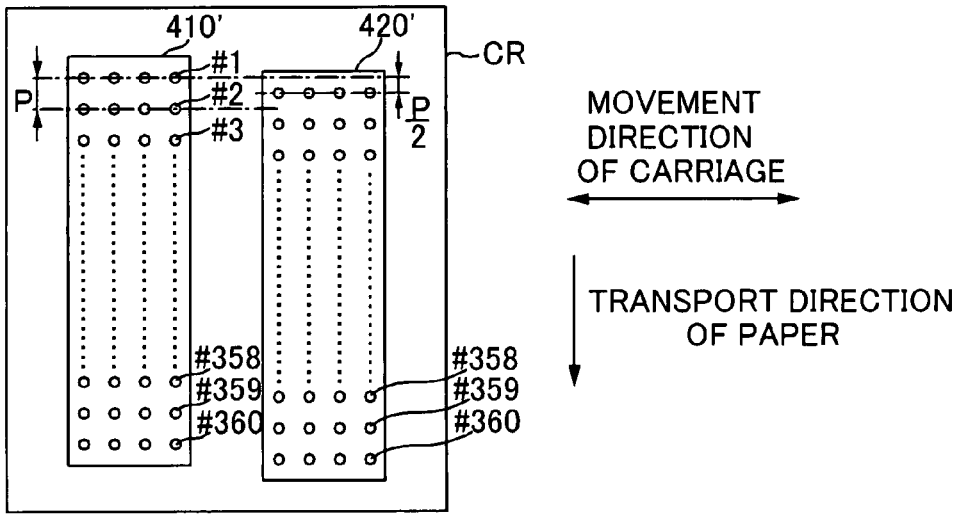
FIG. 12 is a diagram for describing an arrangement of the two heads of the head unit 40' according to the second embodiment.

FIG. 12 is a diagram for describing an arrangement of the two heads of the head unit 40' according to the second embodiment. In FIG. 12, the first head 410' and the second head 420' are seen from above the printer 1'. When seen from above the printer 1', these nozzles are hidden by other components and cannot be seen. However, here, the positions of the nozzles are drawn with solid lines to facilitate understanding of a relationship between the nozzles of the first head 410' and the nozzles of the second head 420'. It should be noted that nozzle rows contained in the first head 410' correspond to the first nozzle row, and nozzle rows contained in the second head 420' correspond to the second nozzle row.

In each head, a black ink nozzle row K, a cyan ink nozzle row C, a magenta ink nozzle row M, and a yellow ink nozzle row Y are formed. Each nozzle row is provided with a plurality of nozzles (360 nozzles each in the second embodiment), which are ejection openings for ejecting ink. The plurality of nozzles in each nozzle row are arranged at a constant nozzle pitch along the transport direction of the paper S. Here, the nozzle pitch is $1/360$ inch. The nozzles of each head are each assigned a number in order from the top of the drawing (#1 to #360).

Regarding the arrangement of the first head 410' and the second head 420' according to the second embodiment, the second head 420' is arranged such that the nozzles of the second head 420' are positioned between the nozzles of the first head 410'. More specifically, nozzle #1 of the second head 420' is arranged to be positioned between nozzle #1 and nozzle #2 of the first head 410'.

Regarding Operation

Next, description is given concerning a printing operation of the printer 1' in the second embodiment. Here, description is given concerning printing operations in high resolution mode and printing operations in high speed printing mode. Whether printing is carried out in high resolution mode or printing is carried out in high speed printing mode can be determined by a user giving an instruction to the computer 110. And information indicating in which mode printing is to be carried out is stored in the memory 114. This information is sent from the computer 110 to the ASIC 60' of the printer 1' when printing is to be carried out.

First, description is given concerning printing in high resolution mode. It should be noted that, for the purpose of description, here, description is given assuming large dots are formed in all the pixels of the image to be printed. However, depending on the image to be printed, there may be some pixels for which dots are not formed.

When carrying out printing in high resolution mode, the ASIC 60'outputs waveform data to the drive signal generation circuit 70 to enable drive signals COM to be generated. Furthermore, when moving the carriage CR, the ASIC 60 performs control of the carriage movement mechanism 30 so that it moves the carriage CR at half the speed of high speed printing mode which is described later. Accordingly, the carriage CR moves forward by 1/720 inch in the movement direction during a cycle T of the drive signals COM.

Figure 13:
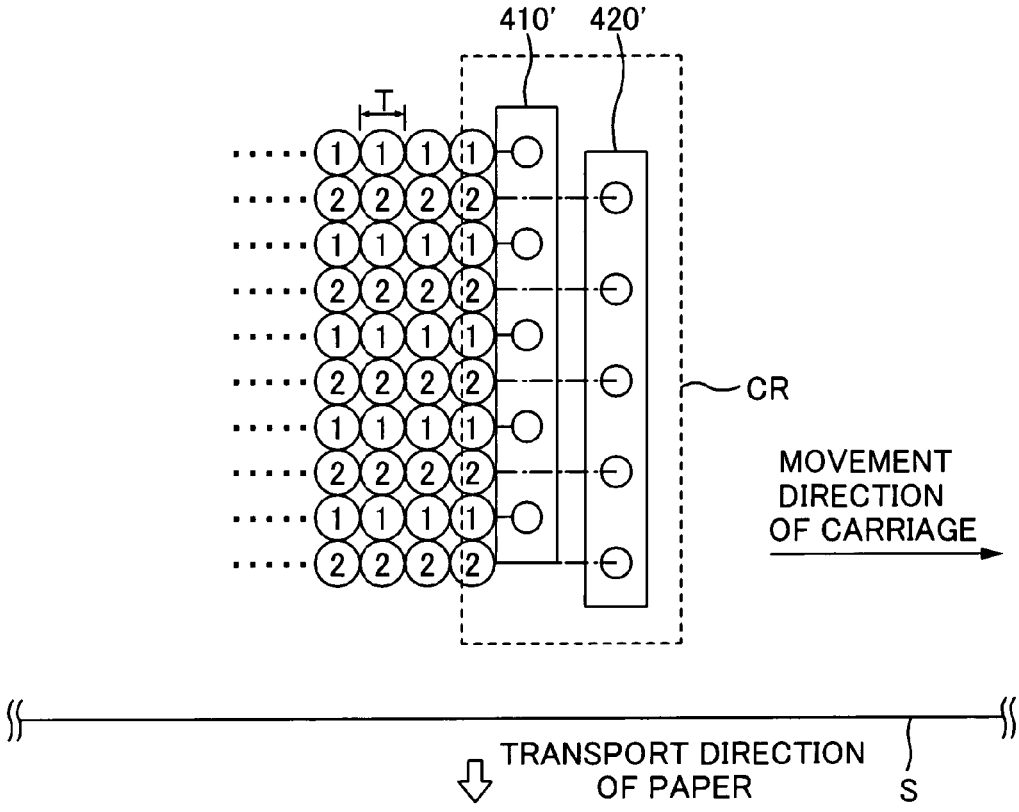
FIG. 13 is a diagram for describing an arrangement of dots when printing has been carried out in high resolution mode according to the second embodiment.

FIG. 13 is a diagram for describing an arrangement of dots when printing has been carried out in high resolution mode according to the second embodiment. FIG. 13 describes only one nozzle row in one head in order to facilitate description of a relationship between the heads and the dots that are formed. Also, for the same reason, the number of nozzles is reduced in FIG. 13. Furthermore, the dots formed by ink droplets ejected from the first head 410' and the second head 420' are indicated by solid line circles. Dots formed by ink droplets ejected from the first head 410' are indicated by a numeral "1" enclosed in a circle. And dots formed by ink droplets ejected from the second head 420' are indicated by a numeral "2" enclosed in a circle. Furthermore, in the second embodiment, the paper S is transported intermittently in the nozzle row direction. Specifically, movement of the carriage CR and transport of the paper S are carried out alternately.

In high resolution mode, drive signals COM are applied to the piezo elements 417 of the first head 410' and the second head 420'. Furthermore, the ink ejection timings are regulated such that dots (first dots) formed by ink droplets ejected from the first head 410' and dots (second dots) formed by ink droplets ejected from the second head 420' are arranged alternately in the direction in which the nozzles are arranged as shown in FIG. 13. As mentioned earlier, the carriage CR advances 1/720 inch in the movement direction during the cycle T of the drive signals COM. And dots shown in FIG. 13 are formed in each of the cycles T. As a result, printing is carried out at 720 dpi.

Next, description is given concerning operation when printing is carried out in high speed printing mode. When printing in high speed printing mode is selected by the user, high speed printing is carried out in an operation as follows.

When carrying out printing in high speed printing mode, the ASIC 60'outputs waveform data to the drive signal generation circuit 70 to enable drive signals COM to be generated. Furthermore, when causing the carriage CR to move, the ASIC 60' performs control of the carriage movement mechanism 30 so that it moves the carriage CR at twice the speed of high resolution mode. Accordingly, the carriage CR advances 1/360 inch in the movement direction during a cycle T of the second drive signals COM_2.

In the second embodiment, as in the first embodiment, white streaks appear in the nozzle row direction when the movement velocity of the carriage CR is merely doubled that of high resolution mode. Accordingly, in the second embodiment as well, the ejection timings for ink droplets of the first head 410' and the second head 420' are made different from that in high resolution mode so as to suppress occurrences of white streaks.

Figure 14:
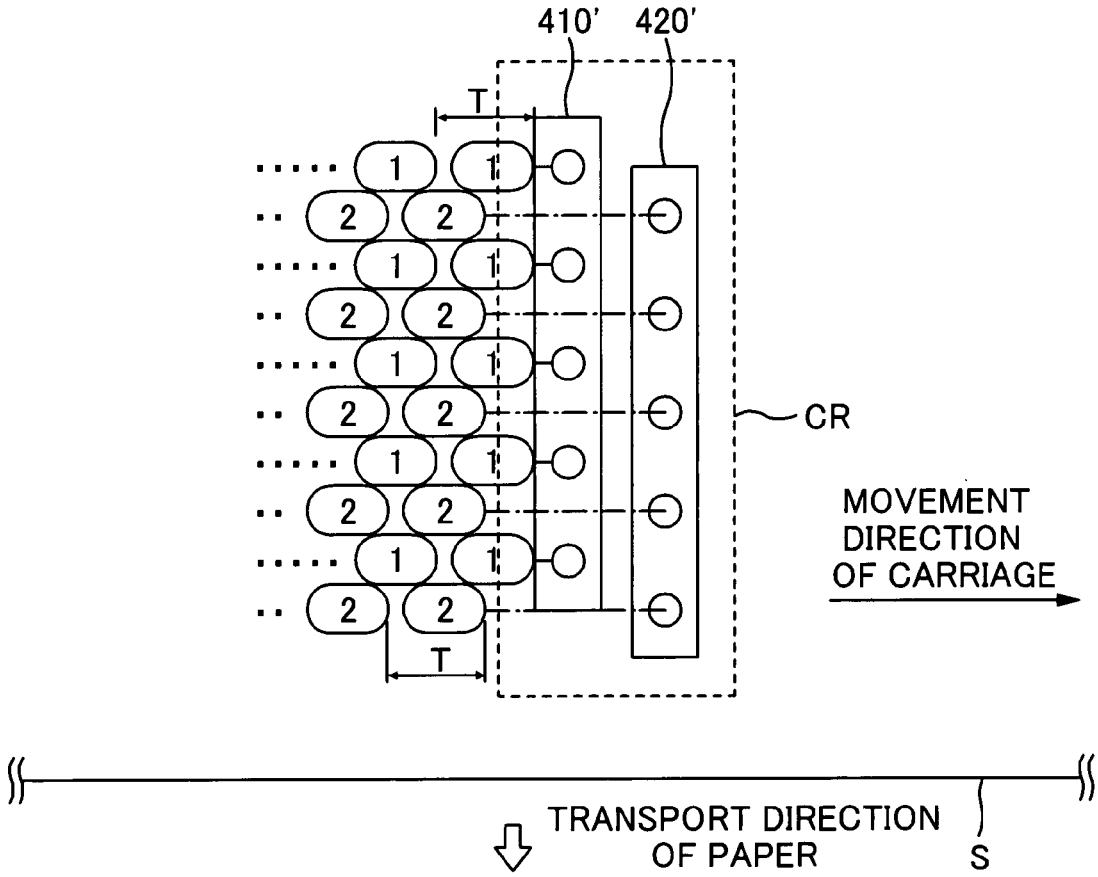
FIG. 14 is a diagram for describing an arrangement of dots when printing is carried out in high speed printing mode according to the second embodiment.

FIG. 14 is a diagram for describing an arrangement of dots when printing is carried out in high speed printing mode according to the second embodiment. FIG. 14 describes only one nozzle row in one head in order to facilitate description of a relationship between the heads and the dots that are formed. Also, for the same reason, the number of nozzles is reduced in FIG. 14. Dots formed by ink droplets ejected from the head of the first nozzle row (the first head 410') are indicated by a numeral "1" enclosed in a circle. Furthermore, dots formed by ink droplets ejected from the head of the second nozzle row (the second head 420') are indicated by a numeral "2" enclosed in a circle.

The movement velocity of the carriage CR in high speed printing mode is twice the speed in high resolution mode. And in high speed printing mode, the ejection timings of ink droplets are regulated to achieve a dot arrangement as shown in FIG. 14. In FIG. 14, the dots (first dots) formed by ink droplets ejected from the first nozzle row (the first head 410') are arranged in the nozzle row direction. Furthermore, the dots (second dots) formed by ink droplets ejected from the second nozzle row (the second head 420') are also arranged in the nozzle row direction. Note that the second dots are formed so as to be positioned between the first dots in the nozzle row direction. And dot rows of the second dots to be formed are displaced from the dot rows of the first dots in a direction perpendicular to the nozzle row direction.

By carrying out printing in this way, the interval between the first dots and the next first dots in the direction perpendicular to the nozzle rows becomes wider than the interval in high resolution mode. And since the movement velocity of the carriage CR in high speed printing mode is twice the velocity of high resolution mode, the printing speed can be approximately doubled.

Other Embodiments

The foregoing embodiments are for the purpose of facilitating understanding of the present invention, and are not to be interpreted as limiting the present invention. The invention can of course be altered and improved without departing from the gist thereof, and includes functional equivalents. In particular, embodiments mentioned below are also included in the present invention.

Regarding the Heads

In the foregoing embodiment, ink was ejected using piezoelectric elements. However, the method for ejecting liquid is not limited to this. Other methods, such as a method for generating bubbles in the nozzles through heat, may also be employed.

Also, in the foregoing embodiments, the head is provided in the carriage. However, it is also possible to provide the head in an ink cartridge which is detachably retained by the carriage.

Overview (1) A liquid ejecting apparatus as a printing apparatus described above includes a first nozzle row (in the first embodiment includes the first head 410, the second head 420, and the third head 430, and in the second embodiment includes the first head 410') in which a plurality of nozzles for forming dots by ejecting ink droplets onto the paper S are arranged with a predetermined pitch, and a second nozzle row (in the first embodiment includes the fourth head 440, the fifth head 450, and the sixth head 460, and in the second embodiment includes the second head 420') in which a plurality of nozzles for forming dots by ejecting ink droplets onto the paper S are arranged with a predetermined pitch, and the second nozzle row is displaced with respect to a position of the first nozzle row in a direction in which the nozzles are arranged.

Furthermore, the liquid ejecting apparatus is provided with a relative movement mechanism (in the first embodiment the paper transport mechanism 20, and in the second embodiment the carriage movement mechanism 30) that causes a position of the paper S with respect to the first nozzle row and second nozzle row to move relatively in a direction perpendicular to the direction in which the nozzles are arranged, the piezo element 417 installed for each nozzle of the first nozzle row and the second nozzle row, and a controller (the ASIC 60 and the head controller HC) that controls the piezo elements 417 and the relative movement mechanism so that dots are formed in either one of a first mode (high resolution mode) and a second mode (high speed printing mode).

And when dots are to be formed for all pixels in the first mode, first dots formed by nozzles of the first nozzle row and second dots formed by nozzles of the second nozzle row are alternately formed in the direction in which the nozzles are arranged, and a dot row of the first dots and a dot row of the second dots are formed in a direction perpendicular to the direction in which the nozzles are arranged. Furthermore, when dots are to be formed for all pixels in the second mode, the first dot row is formed so that the first dots are arranged in the direction in which the nozzles are arranged and the second dot row, in which the second dots are arranged in the direction in which the nozzles are arranged, is formed so as to be displaced from the first dot row in a direction perpendicular to the direction in which the nozzles are arranged, and a distance in the perpendicular direction between the first dots is larger than a distance between the first dots in the first mode.

By doing this, printing in high resolution mode and printing in high speed printing mode can be carried out. For example, by carrying out printing in the first mode, printing can be carried out at a high resolution, and in the second mode, by setting a faster relative velocity between the paper S and the heads high speed printing can be carried out.

(2) Furthermore, the relative movement mechanism sets a relative movement velocity between the paper S and the first nozzle row during the second mode faster than a relative velocity during the first mode.

By doing this, the relative velocity of the nozzle rows to the paper S is faster in the second mode than in the first mode, and therefore dots can be formed faster in the second mode than in the first mode.

(3) Furthermore, the relative movement mechanism is the paper transport mechanism 20 (FIG. 1) that causes the paper S to be transported in a direction perpendicular to the direction in which the nozzles are arranged.

By doing this, with a configuration of printer such as the line head printer 1, it becomes possible to create a first mode and a second mode and carry out printing in high resolution mode and carry out printing in high speed printing mode.

(4) Furthermore, the relative movement mechanism may be a carriage movement mechanism 30 (FIG. 10) that causes the first nozzle row and the second nozzle row to move in a direction perpendicular to the direction in which the nozzles are arranged.

By doing this, with a configuration such as the inkjet printer 1'of the second embodiment, it becomes possible to create a first mode and a second mode and carry out printing in high resolution mode and carry out printing in high speed printing mode.

(5) Furthermore, a state (FIG. 4) is achieved in which nozzles of the second nozzle row are positioned so as to be centered between nozzles of the first nozzle row in the direction in which the nozzles are arranged.

By doing this, the nozzles of the first nozzle row and the nozzles of the second nozzle row can be configured to have a uniform nozzle pitch in the direction in which the nozzles are arranged.

(6) Furthermore, with the liquid ejecting apparatus including all the above-described structural components, since almost all of the previously described effects can be achieved, the object of the present invention can be achieved most effectively.

(7) Furthermore, a printing system can be provided having the above-described liquid ejecting apparatus having an input device (a keyboard or the like) for inputting instructions as to whether dots are to be formed in either mode of high resolution mode (first mode) and high speed printing mode (second mode) the dots are to be formed.

(8) And it goes without saying that a liquid ejecting method is possible which includes a step of receiving an instruction as to whether to carry out dot forming in a first mode or to carry out dot forming in a second mode, a step of when an instruction has been received for carrying out dot forming in the first mode, alternately forming first dots formed by nozzles of a first nozzle row and second dots formed by nozzles of a second nozzle row in a direction in which the nozzles are arranged and forming a dot row of the first dots and a dot row of the second dots in a direction perpendicular to the direction in which the nozzles are arranged, and a step of when an instruction has been received for carrying out dot forming in the second mode, forming the first dot row so that the first dots are arranged in the direction in which the nozzles are arranged and forming the second dot row, in which the second dots are arranged in the direction in which the nozzles are arranged, so as to be displaced from the first dot row in a direction perpendicular to the direction in which the nozzles are arranged, wherein a distance in the perpendicular direction between the first dots is larger than a distance between the first dots in the first mode.

What is claimed is:

1. A liquid ejecting apparatus comprising:

a first nozzle row in which a plurality of nozzles for forming dots on a medium by ejecting liquid droplets onto the medium are arranged with a predetermined pitch, a second nozzle row in which a plurality of nozzles for forming dots on the medium by ejecting liquid droplets onto the medium are arranged with the predetermined pitch, the second nozzle row being displaced with respect to a position of the first nozzle row in a direction in which the nozzles are arranged, a relative movement mechanism that causes a position of the medium with respect to the first nozzle row and second nozzle row to move relatively in a direction perpendicular to the direction in which the nozzles are arranged, a liquid ejecting section installed for each nozzle of the first nozzle row and the second nozzle row, and a controller that controls the liquid ejecting section and the relative movement mechanism so that dots are formed in either mode of a first mode and a second mode, wherein, when dots are to be formed for all pixels in the first mode, first dots formed by nozzles of the first nozzle row and second dots formed by nozzles of the second nozzle row are alternately formed in the direction in which the nozzles are arranged, and a dot row of the first dots and a dot row of the second dots are formed in a direction perpendicular to the direction in which the nozzles are arranged, and when dots are to be formed for all pixels in the second mode, the first dot row is formed so that the first dots are arranged in the direction in which the nozzles are arranged, and the second dot row in which the second dots are arranged in the direction in which the nozzles are arranged is formed so as to be displaced from the first dot row in the perpendicular direction, and a distance in the perpendicular direction between the first dots is larger than a distance between the first dots in the first mode.

2. A liquid ejecting apparatus according to claim 1, wherein the relative movement mechanism sets a relative movement velocity between the medium and the first nozzle row during the second mode faster than a relative velocity during the first mode.

3. A liquid ejecting apparatus according to claim 1, wherein the relative movement mechanism is a medium transport mechanism that causes the medium to be transported in a direction perpendicular to the direction in which the nozzles are arranged.

4. A liquid ejecting apparatus according to claim 1, wherein the relative movement mechanism is a nozzle row movement mechanism that causes the first nozzle row and the second nozzle row to move in a direction perpendicular to the direction in which the nozzles are arranged.

5. A liquid ejecting apparatus according to claim 1, wherein nozzles of the second nozzle row are positioned centered between nozzles of the first nozzle row in the direction in which the nozzles are arranged.

6. A printing system comprising:

a first nozzle row in which a plurality of nozzles for forming dots on a medium by ejecting liquid droplets onto the medium are arranged with a predetermined pitch, a second nozzle row in which a plurality of nozzles for forming dots on the medium by ejecting liquid droplets onto the medium are arranged with the predetermined pitch, the second nozzle row being displaced with respect to a position of the first nozzle row in a direction in which the nozzles are arranged, a relative movement mechanism that causes a position of the medium with respect to the first nozzle row and second nozzle row to move relatively in a direction perpendicular to the direction in which the nozzles are arranged, a liquid ejecting section installed for each nozzle of the first nozzle row and the second nozzle row, an input device for inputting an instruction as to whether dots are to be formed in either mode of a first mode and a second mode, and a controller that controls the liquid ejecting section and the relative movement mechanism so that dots are formed in either mode of the first mode and the second mode in accordance with the instruction inputted from the input device, wherein, when dots are to be formed for all pixels in the first mode, first dots formed by nozzles of the first nozzle row and second dots formed by nozzles of the second nozzle row are alternately formed in the direction in which the nozzles are arranged, and a dot row of the first dots and a dot row of the second dots are formed in a direction perpendicular to the direction in which the nozzles are arranged, and when dots are to be formed for all pixels in the second mode, the first dot row is formed so that the first dots are arranged in the direction in which the nozzles are arranged and the second dot row in which the second dots are arranged in the direction in which the nozzles are arranged is formed so as to be caused to be displaced from the first dot row in the perpendicular direction, and a distance in the perpendicular direction between the first dots is larger than a distance between the first dots in the first mode.

* * * * *